US009592581B2

(12) United States Patent
Toycen

(10) Patent No.: US 9,592,581 B2
(45) Date of Patent: Mar. 14, 2017

(54) TOOL GRINDER

(71) Applicant: Jeff Toycen, Ottawa (CA)

(72) Inventor: Jeff Toycen, Ottawa (CA)

( * ) Notice: Subject to any disclaimer, the term of this patent is extended or adjusted under 35 U.S.C. 154(b) by 0 days.

(21) Appl. No.: 14/851,537

(22) Filed: Sep. 11, 2015

(65) Prior Publication Data

US 2016/0074983 A1 Mar. 17, 2016

Related U.S. Application Data

(60) Provisional application No. 62/049,425, filed on Sep. 12, 2014.

(51) Int. Cl.

| | |
|---|---|
| ***B24B 3/00*** | (2006.01) |
| ***B24B 3/06*** | (2006.01) |
| ***B24B 41/02*** | (2006.01) |
| ***B24B 41/06*** | (2012.01) |

(52) U.S. Cl.

CPC ..... *B24B 3/06* (2013.01); *B24B 41/02* (2013.01); *B24B 41/066* (2013.01)

(58) Field of Classification Search

CPC ..... B24B 3/06; B24B 41/02; B24B 41/006

USPC ..... 451/127

See application file for complete search history.

(56) References Cited

U.S. PATENT DOCUMENTS

| | | | | |
|---|---|---|---|---|
| 3,553,908 | A * | 1/1971 | Boehm | B24B 41/066 451/405 |
| 4,134,235 | A * | 1/1979 | Maharidge | B24B 3/06 451/214 |
| 4,384,431 | A * | 5/1983 | Jackson | B24B 19/00 409/191 |
| 4,461,121 | A * | 7/1984 | Motzer | B24B 27/0061 451/226 |
| 4,490,944 | A * | 1/1985 | Veale | B24B 27/04 451/127 |
| 4,597,226 | A * | 7/1986 | Jewett, Sr. | B24B 3/06 451/214 |
| 4,916,866 | A * | 4/1990 | Bernard | B24B 3/06 451/220 |
| 7,874,895 | B1 * | 1/2011 | Toycen | B24B 3/26 451/11 |
| 8,182,313 | B2 * | 5/2012 | Schaeferling | B23F 19/057 451/11 |
| 8,708,774 | B2 * | 4/2014 | Diplotti | B24B 3/021 451/11 |
| 2016/0074983 | A1 * | 3/2016 | Toycen | B24B 3/06 451/127 |

* cited by examiner

*Primary Examiner* — George Nguyen

(74) *Attorney, Agent, or Firm* — Borden Ladner Gervals LLP

(57) ABSTRACT

The end mill grinding device of the present invention includes a tool spindle assembly and a motor tower which enables multi-axis positioning of a sharpening wheel in relation to an end mill cutting tool being sharpened, for sharpening the end mill tool. The present invention combines linear sharpening and radial tool end grinding capability in the same device.

8 Claims, 13 Drawing Sheets

TOOL GRINDER

This application claims the benefit of priority of U.S. Provisional Patent Application No. 62/049,425 filed Sep. 12, 2014, the content of which is incorporated herein by reference.

TECHNICAL FIELD

The present invention relates to a machine shop grinder or sharpener, for example a bench-top end mill sharpener.

BACKGROUND OF THE INVENTION

Machine shops universally use end mills in computerized milling machines, e.g. computer numerical control (CNC) milling machines, as a cutting tool for all industrial milling applications, such as profile milling, tracer milling, face milling, and plunging. End mills are categorized by the number of flutes, the helix angle, the material and the coating material. Over the last two decades the speed of CNC milling machines has increased ten fold, requiring the use of milling cutters with exotic coatings or made from solid carbide to improve part cycle time and tool life. Moreover, contemporary tools have more aggressive geometry, are more expensive than regular high-speed steel cutters, and are more difficult to recondition. Performance end mill type milling cutters used in the mainstream production job shop market are made from the most premium grades of solid carbide, and are rotating at spindle speeds much higher than ever before, requiring different structural and performance geometry with high finish and accuracy. A high-level of attention must be given to tool features, tolerances and finish or they will not cut and extract material with tolerable heat and friction at higher speeds.

Cemented tungsten carbide tools consist of a composition of tungsten carbide powder with cobalt binder. The binder breaks down over time due to cycling of load moments, causing the leaching of the cobalt away from the carbide powder. This leads to localized degradation of the integrity of the substrate to such a degree that the area of the end mill cutter tool that was under the highest loads should not be returned to service as the material has been altered at the inter-granular level. In addition, current protocols, such as ISO9000, prescribe that if an end mill cutter diameter is altered requiring an edit to the program speeds, feeds and offsets used to run the part, the part is required to be re-inspected prior to commencing production. Re-inspection slows down the manufacturing/shop process and is therefore unwelcome. Also, the end mill cutter tool that has just been returned to service generally does not perform as well as or as long as a new one.

Even with good equipment, an experienced technician with a keen eye and magnification is required to recondition end mill cutting tools. However, careless reconditioning can result in disproportionately maintained clearance angles and flute geometry, affecting friction and chip evacuation and causing a reduction in performance.

In small carbide milling cutters, the area of high exposure to heat, load and friction is a "throw away" or for one time use, due to material breakdown. As a general rule, tools that can be ground back into areas free of substrate breakdown can be effectively re-sharpened with shop support equipment. In general, shops do not use reconditioned tools because they are usually small and associated with too many issues, which affect the true reconditioning cost.

High loads combined with more radical tool geometry, and stringent concentricity requirements mean new carbide end-mill cutter tools, as a rule, must be held more accurately with greater force during the machining process than their high-speed steel predecessors. Carbide end-mill tools are also used differently in shops today, wherein faces on parts are often machined with stub flute tools having solid reduced necks giving greater stability at higher material removal rates, although long flutes are still the method of choice for finishing larger faces with high finish.

To sharpen carbide end-mill cutters, the end is cut off to get into new, unused material, while watching to ensure the tool does not over heat. Furthermore, special care must be taken to ensure: the diameter does not change; a flat or "notch" is produced, so that the tool can be held well in a side lock tool holder; a reduced neck is ground; a ball nose is resharpened; and a corner rad "bull nose" champher or blend radius is produced.

The principal attraction of conventional bench top sharpeners, such as those produced by Cuttermaster®, Darex®, and Chevalier®, has been cost, and a perceived ease of use. Moreover, they have been servicing a market in which High Speed Steel (HSS) tools were being used in an environment with mostly conventional or CNC machines having spindles designed to operate below 5000 rpm that would tolerate a reground cutter, i.e. rotational speeds and part feeds were lower, with less pressure on part cycle.

SUMMARY OF THE INVENTION

An object of the present invention is to overcome at least one of the shortcomings of the prior art by providing a tool grinder able to easily reproduce tool geometry, preferably cutter end geometry, most preferably without heat damage to the tool.

Accordingly, the present invention relates to a tool grinding device and rotating cutting tool sharpening device comprising a base, a tool spindle assembly which supports a tool or rotatary cutting tool, and enables reciprocation in a first direction parallel to the base and a motor tower assembly which supports a motor for rotating a grinding or sharpening wheel and enables reciprocation along a second axis parallel to the base. The motor tower assembly further enables rotation of the motor about a vertical axis intersecting with the motor axis. The motor tower assembly also enables tilting of the motor axis relative to horizontal about a tilt axis perpendicular to the motor axis, for maximum versatility in orientation of the wheel relative to the tool. The tower assembly is movable between a first position, wherein an end face of the wheel is parallel to the tool axis and vertical or at different angles from vertical, and a second position wherein the end face is perpendicular to the tool axis and vertical or at different angles from vertical so that the end face of the wheel faces an axial end face of the tool in the second position or is positioned beside the tool behind the axial end face.

In one aspect, the invention provides a device for sharpening a rotatary cutting tool. The device includes a main base having first and second tracks oriented at a right angle to one another; a tool spindle assembly for holding the cutting tool for sharpening, a sharpening wheel for sharpening the cutting tool; and a motor tower assembly for rotatably supporting the sharpening wheel at different orientations relative to the cutting tool. The tool spindle assembly includes a spindle base reciprocatable on the main base along the first track in a first direction and a tool spindle mounted in the first carriage for receiving and reciprocating the cutting tool along a longitudinal axis of the cutting tool and parallel to the first direction. The motor tower assembly includes a tower base reciprocatable on the main base along the second track in a second direction perpendicular to the first direction. The tower base is rotatable on the main base about a vertical tower axis. The motor tower further includes a motor for rotating the sharpening wheel about a motor axis and a frame on the platform for supporting the motor with the motor axis intersecting the tower axis. The motor is tiltably mounted in the frame for tilting of the motor axis from horizontal to an angle to horizontal about a tilt axis intersecting with and perpendicular to the motor axis. The motor tower is movable from a first position wherein an end face of the sharpening wheel is parallel to the cutting tool axis and vertical or at different angles from vertical, to a second position wherein the end face is perpendicular to the cutting tool axis and vertical or at different angles from vertical so that the end face of the sharpening wheel faces an axial end face of the cutting tool in the second position, or is positioned beside the cutting tool behind the axial end face, the tower base in the second position partially overlapping the first track.

In another aspect, the invention provides a tool grinding device of the invention, which includes a generally horizontal, planar base, a tool spindle assembly for holding the tool and a motor mount assembly for rotating and positioning a grinding wheel at different orientations relative to the tool. The base includes first and second tracks oriented at a right angle to one another, a first sliding carriage mounted on the base for reciprocal movement along the first track in a first direction and a second sliding carriage mounted on the base for reciprocal movement along the second track in a second direction perpendicular to the first direction. The tool spindle assembly includes a rotating platform mounted on the first sliding carriage and rotatable on the first sliding carriage about a vertical axis on the spindle carriage and a tool spindle mounted on the rotating platform for receiving and reciprocating the tool along a longitudinal axis of the tool. The motor tower assembly includes a tower base mounted to the second sliding carriage and rotatable about a vertical tower axis, a motor for rotating the grinding wheel about a motor axis, and a frame extending perpendicular to the platform for supporting the motor with the motor axis intersecting the tower axis, the frame tiltably suspending the motor for orientation of the motor axis parallel to the platform or at an angle thereto. With this arrangement, the motor tower is movable from a first position wherein an end face of the grinding wheel is parallel to the tool axis and vertical or at different angles from vertical, to a second position wherein the end face is perpendicular to the tool axis and vertical or at different angles from vertical so that the end face of the grinding wheel faces an axial end face of the tool in the second position, or is positioned beside the tool behind the axial end face, the tower base in the second position partially overlapping the first sliding carriage.

In one embodiment of the tool grinding or sharpening device of the invention, the second sliding carriage includes a longitudinal dovetail groove extending in the first direction and the tower assembly includes a lock for interlocking engagement with the dovetail groove and for selectively locking the tower base to the second sliding carriage.

In another embodiment, the motor is a DC motor, preferably a variable speed DC motor and the grinding or sharpening wheel is a CBN wheel.

BRIEF DESCRIPTION OF THE DRAWINGS

An exemplary embodiment of the invention will be described in greater detail with reference to the accompanying drawings which represent preferred embodiments thereof, wherein.

DETAILED DESCRIPTION OF AN EXEMPLARY EMBODIMENT

An exemplary device in accordance with the invention for the grinding or sharpening a tool, for example a rotating cutting tool, is illustrated in the attached drawings and the principle construction of an exemplary embodiment of the device will be discussed in the following with reference to FIGS. 1 to 9. The exemplary embodiment described is an end mill cutter sharpening device.

The end-mill (or any other kind of rotating cutting tool) sharpening device in accordance with the present invention, has improved face grinding capabilities as compared to conventional grinding tools, provides a better opportunity for elaborate feature reproduction and includes a very stable sharpening wheel mounting for the achievement of improved surface finishes.

Figure 1:
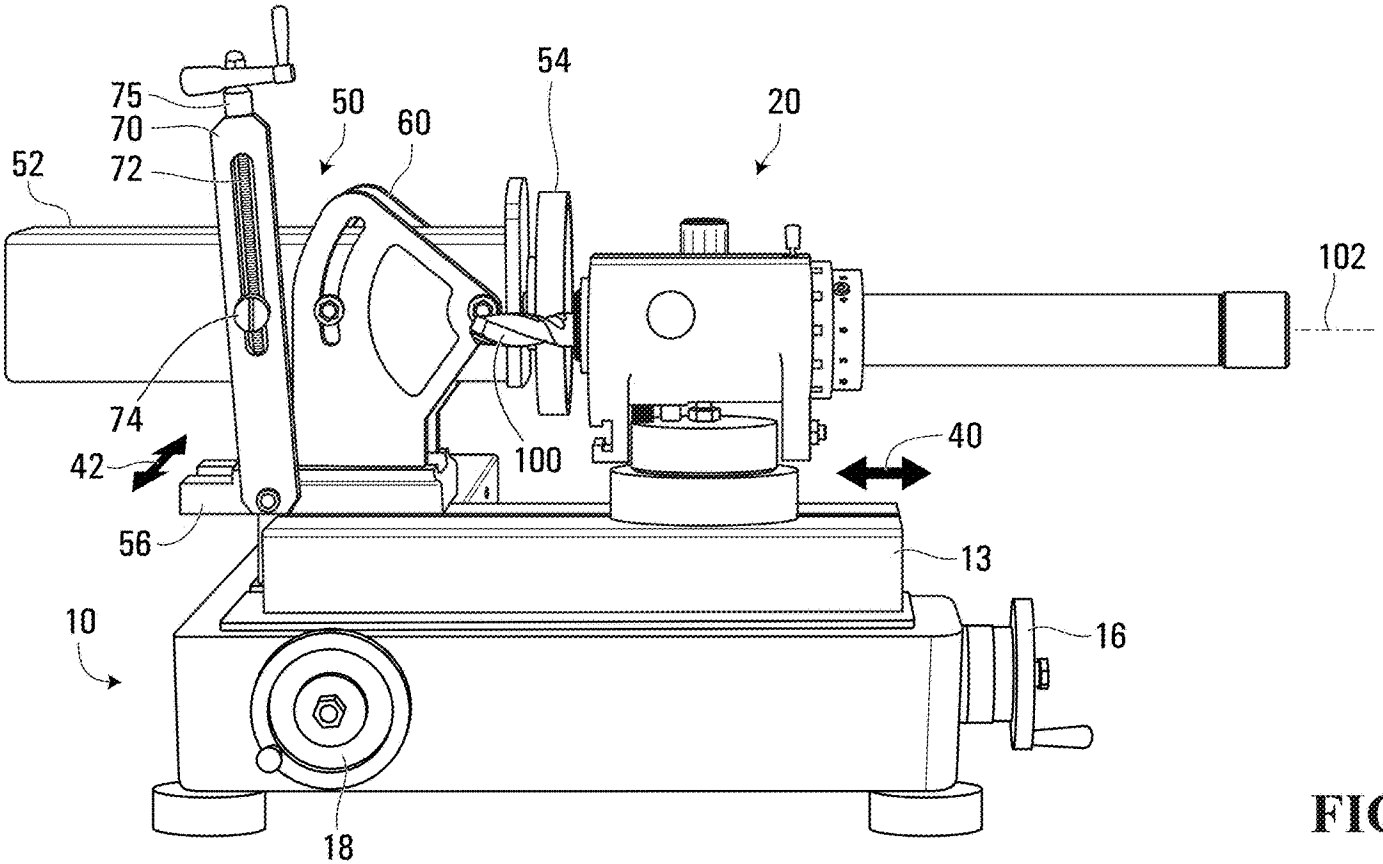
FIG. 1 is a perspective side view of an exemplary embodiment of an end mill tool sharpener in accordance with the present invention.
Figure 2:
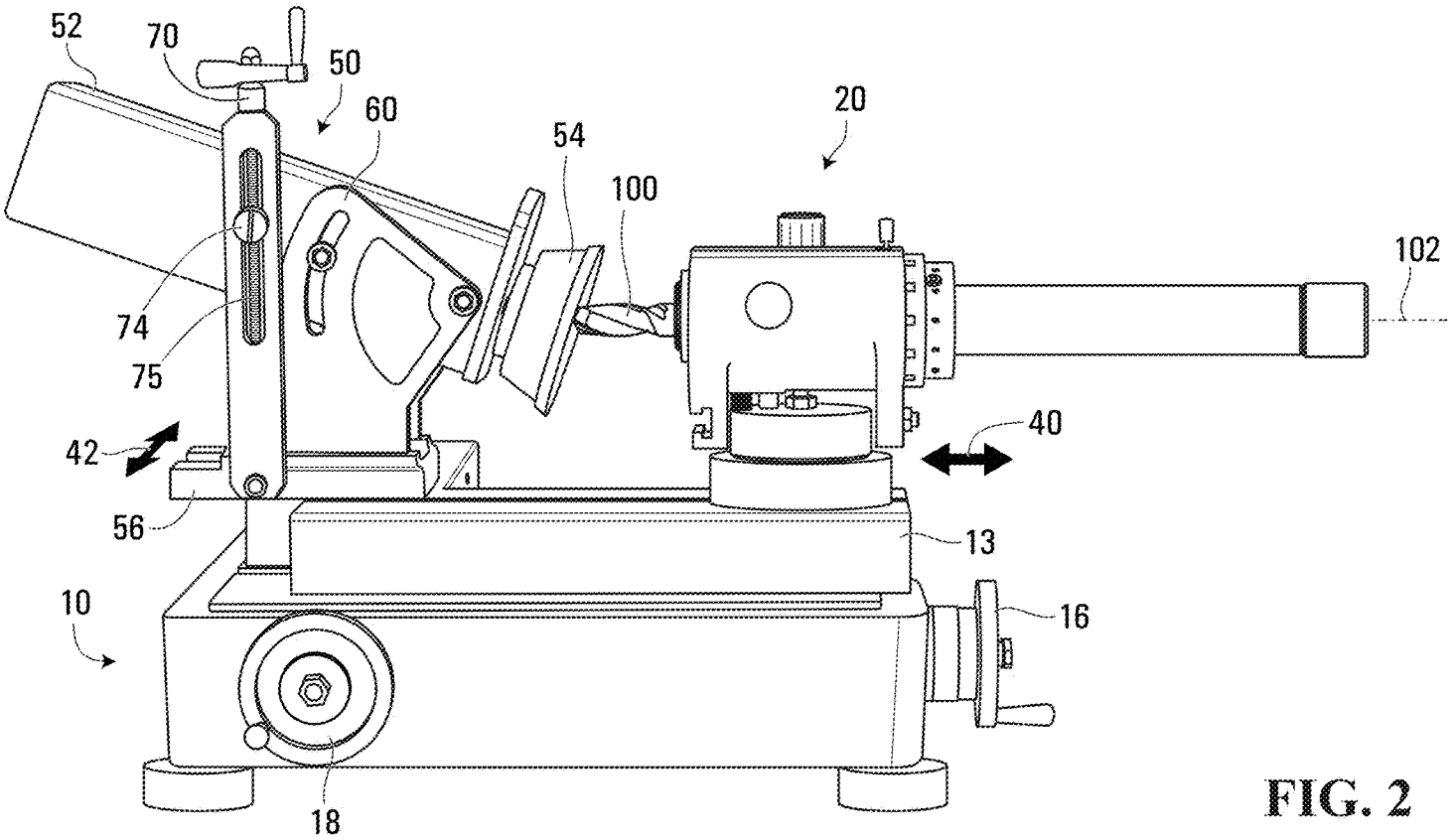
FIG. 2 is a perspective side view of an exemplary embodiment of an end mill tool sharpener in accordance with the present invention, illustrating the motor axis tilted from horizontal.
Figure 3:
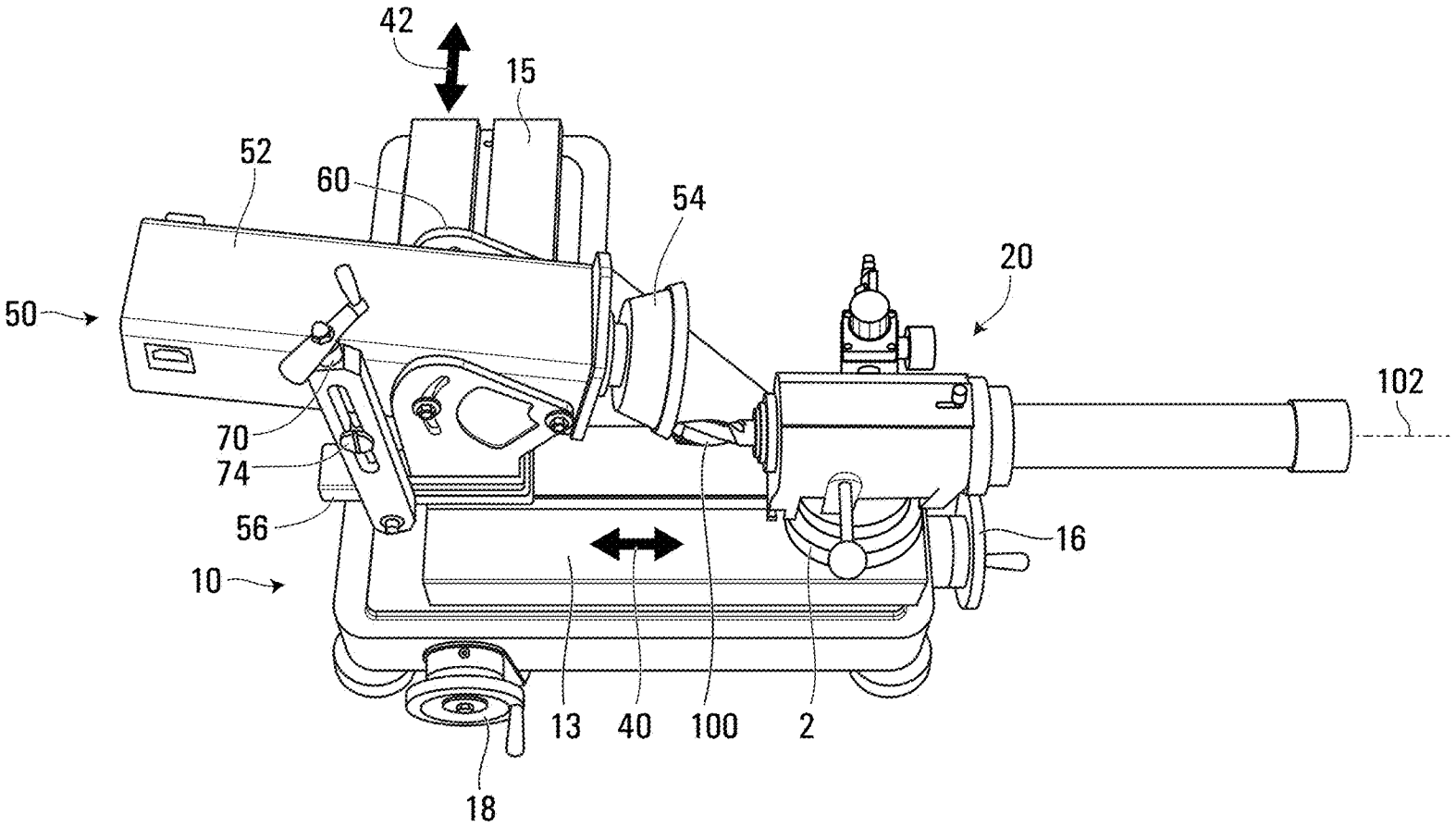
FIG. 3 is a perspective top view of the exemplary embodiment of FIG. 2.

As is apparent from FIGS. 1 to 3, the principle parts of the device of the invention include a main base 10, preferably a ground stone base for rigidity and harmonic stability, a multi-axis tool spindle assembly 20 and a multi-axis motor mount assembly 50.

Figure 4:
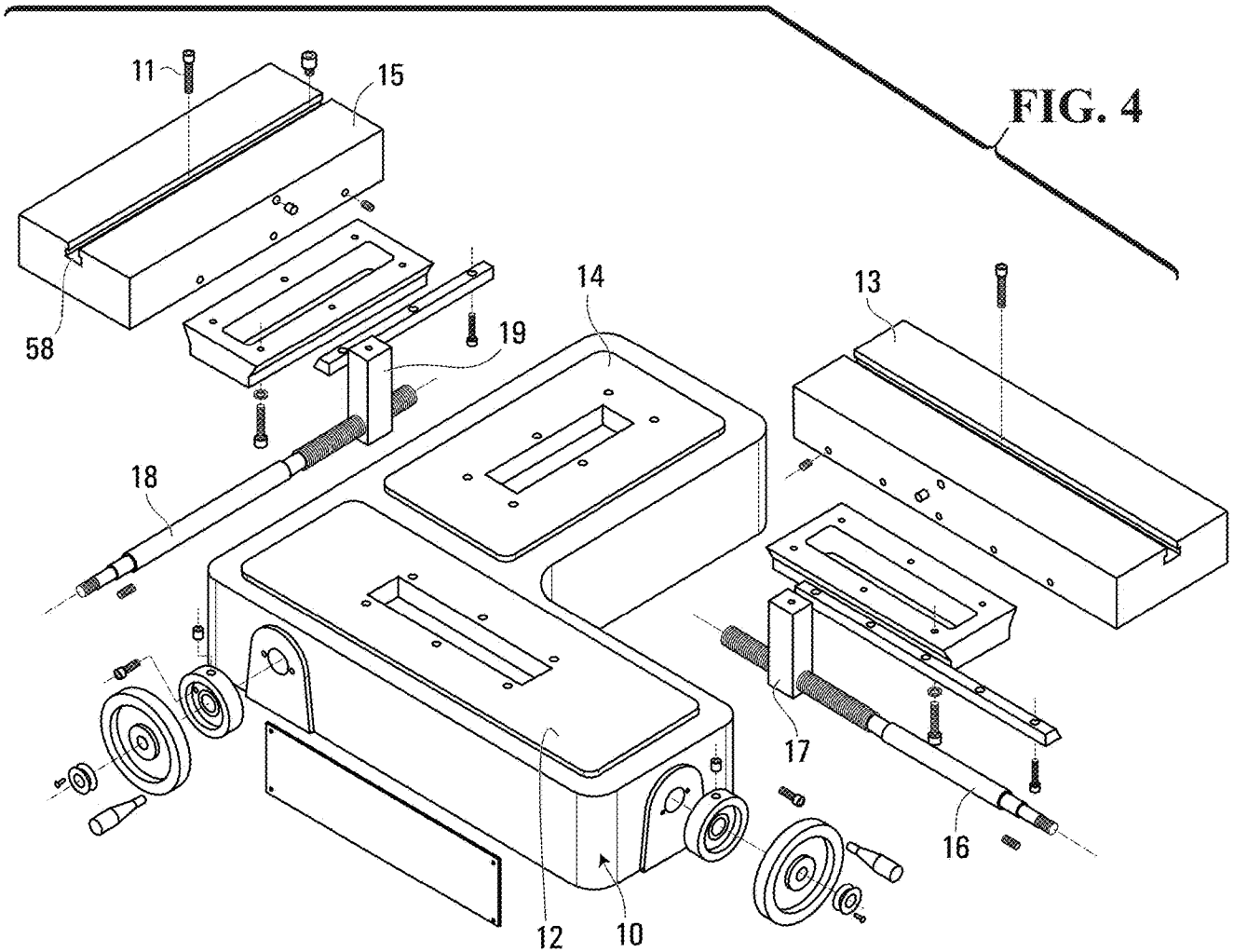
FIG. 4 is an exploded view of the main base of the exemplary embodiment of FIG. 1.

The device shown in FIGS. 1 to 3 includes the main base 10, the detailed construction of which will be discussed with reference to FIG. 4. The main base 10 includes a first track 12 extending in a first direction 40 of the base, the main longitudinal direction of the base and a second track 14 perpendicular to the first track 12 and extending in a second direction 42, the crossfeed direction of the base 10. A first sliding carriage 13, the longitudinal sliding plate, is slidably guided along track 12 for movement in the first direction 40.

Reciprocation of the first sliding carriage 13 is achieved by way of a first threaded spindle 16 rotatably mounted in the base 10 and a square nut 17 engaged thereon, the first sliding carriage being bolted onto the square nut 17 by a bolt 11. Rotation of spindle 16 in opposite directions results in movement of the first sliding carriage 13 in opposite directions. A second sliding carriage 15, the crossfeed sliding plate, is slidably guided along track 14 for movement in the second direction 42. Reciprocation of the second sliding carriage 15 is achieved by way of a second threaded spindle 18 rotatably mounted in the base 10 and a square nut 19 engaged thereon, the second sliding carriage 15 being bolted onto the square nut 19 by another bolt 11. Rotation of spindle 18 in opposite directions results in movement of the second sliding carriage 15 in opposite directions.

Figure 5:
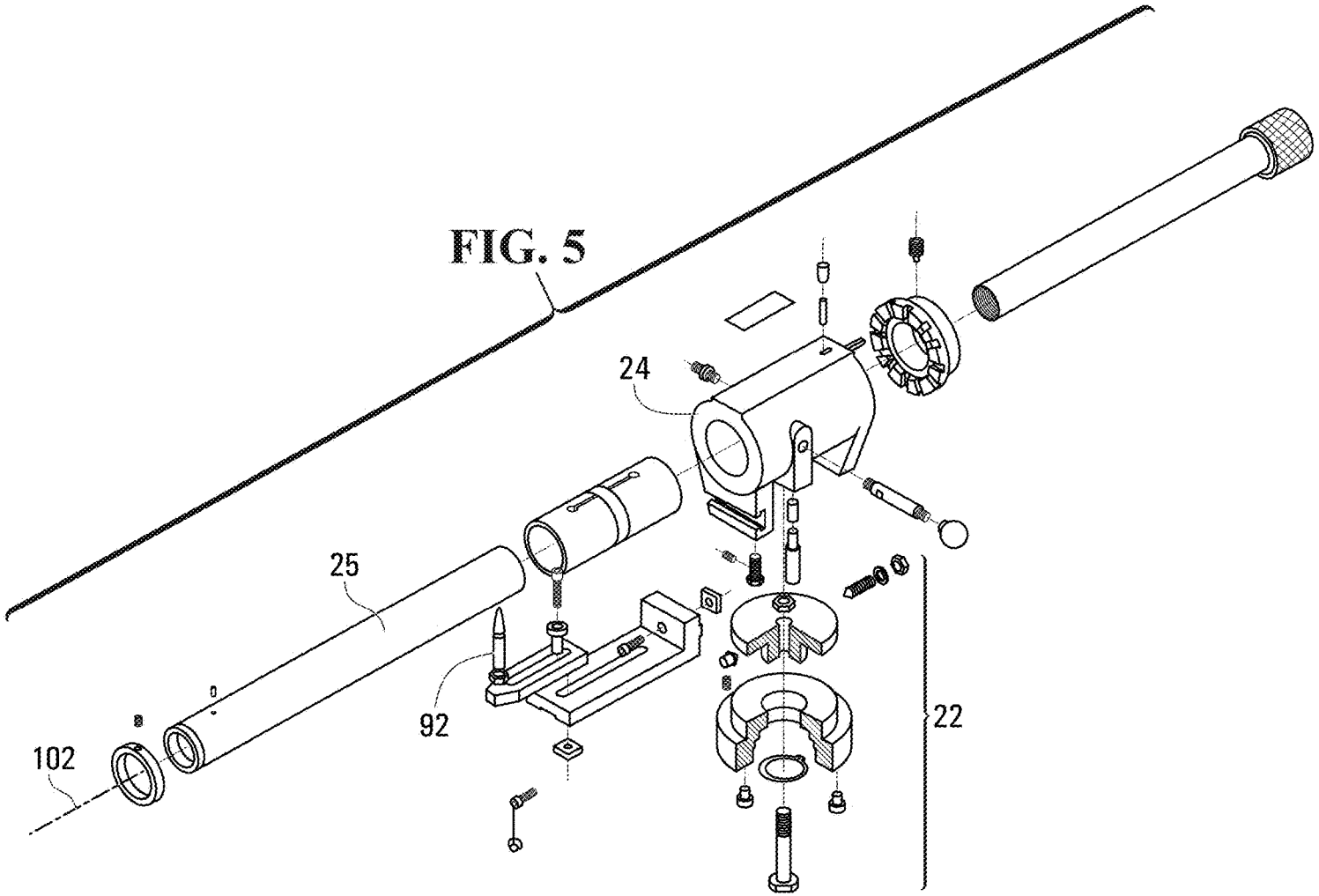
FIG. 5 is an exploded view of the spindle assembly of the exemplary embodiment of FIG. 1.

The device shown in FIGS. 1 to 3 also includes the tool spindle assembly 20, the detailed construction of which will be discussed with reference to FIG. 5. The tool spindle assembly 20 for holding the cutting tool 100 for sharpening includes a rotating platform 22 mounted on the first sliding carriage 13 of the main base 10 for reciprocation in the first direction 40. The tool spindle assembly further includes a tool spindle carriage 24 mounted on the rotating platform 22 and supporting a tool spindle 25 for receiving and reciprocating the cutting tool 100 along a longitudinal axis 102 of the cutting tool parallel to the first direction 40. The tool spindle 25 is principally of conventional construction and need not be discussed in any further detail herein.

Figure 6A:
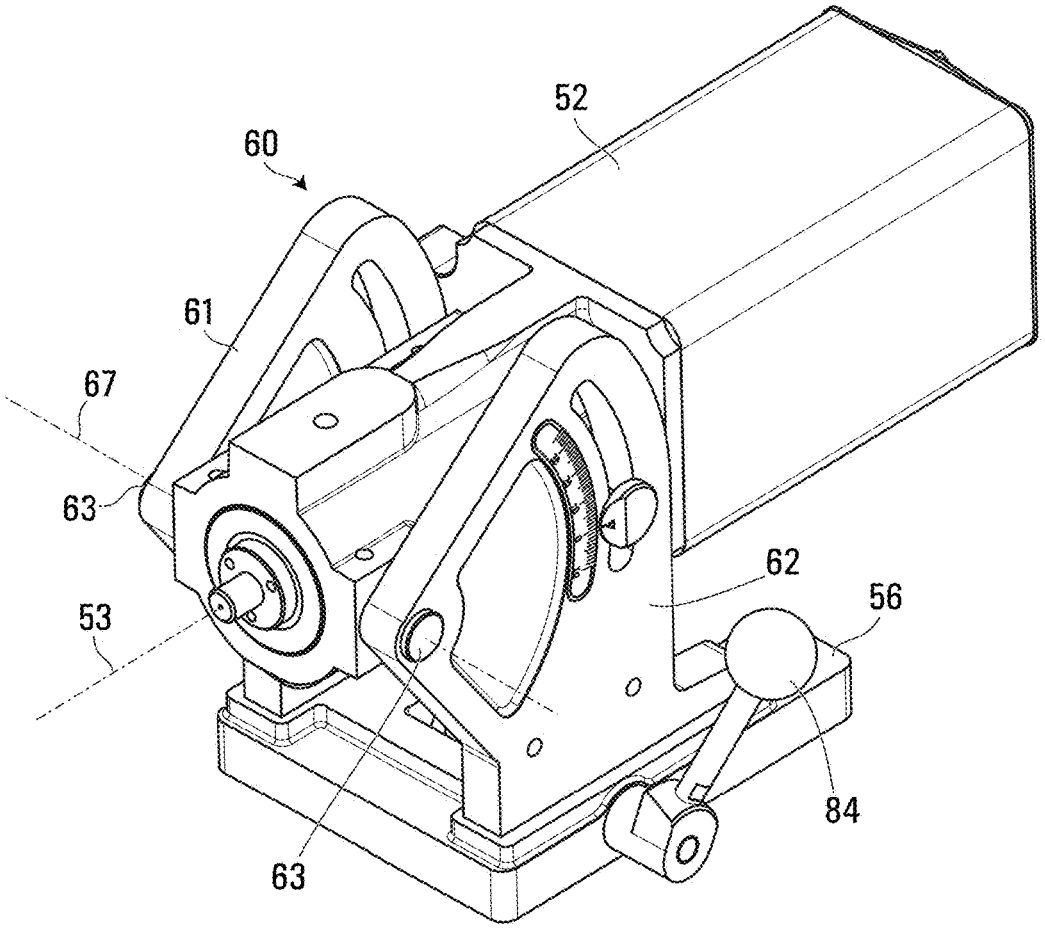
FIG. 6*a* shows an isometric side view of the motor tower assembly of the exemplary embodiment of FIG. 1.
Figure 6B:
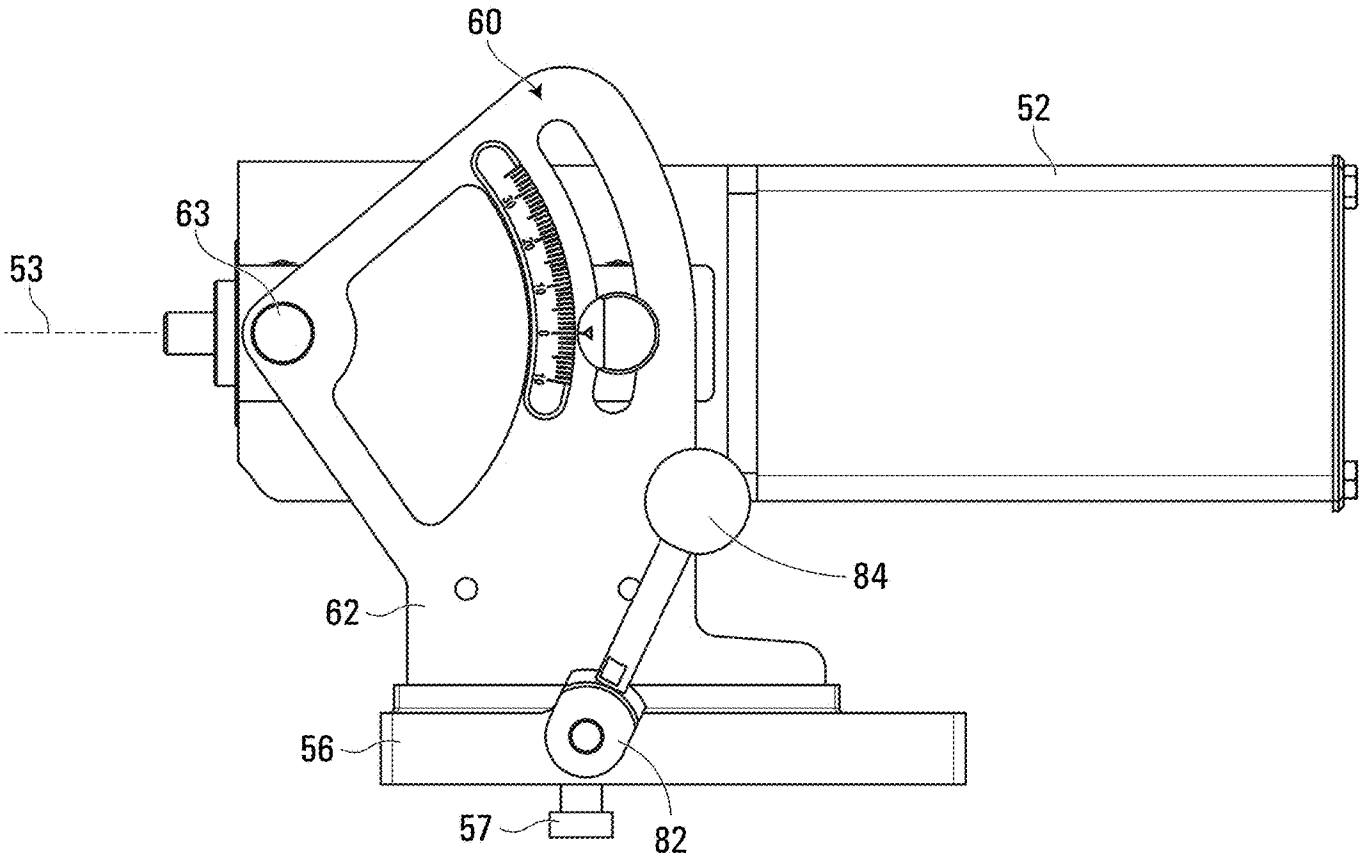
FIG. 6*b* shows an elevational side view of the motor tower assembly of FIG. 6*a;*
Figure 6C:
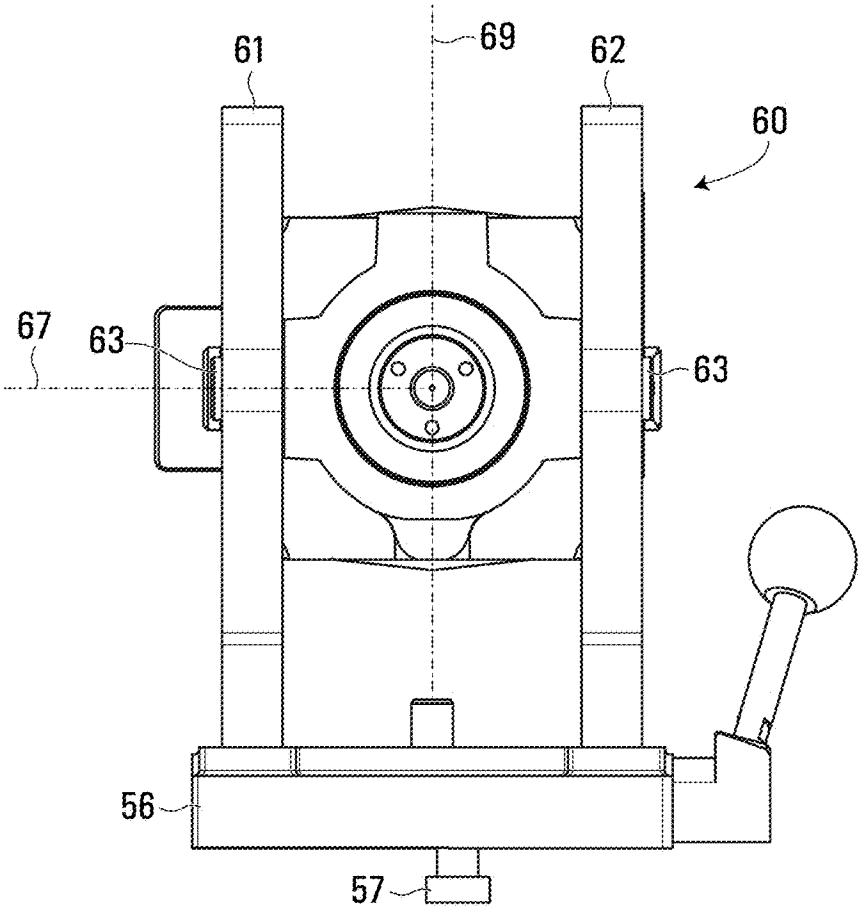
FIG. 6*c* shows an elevational front view of the motor tower assembly of FIG. 6*a;*
Figure 7:
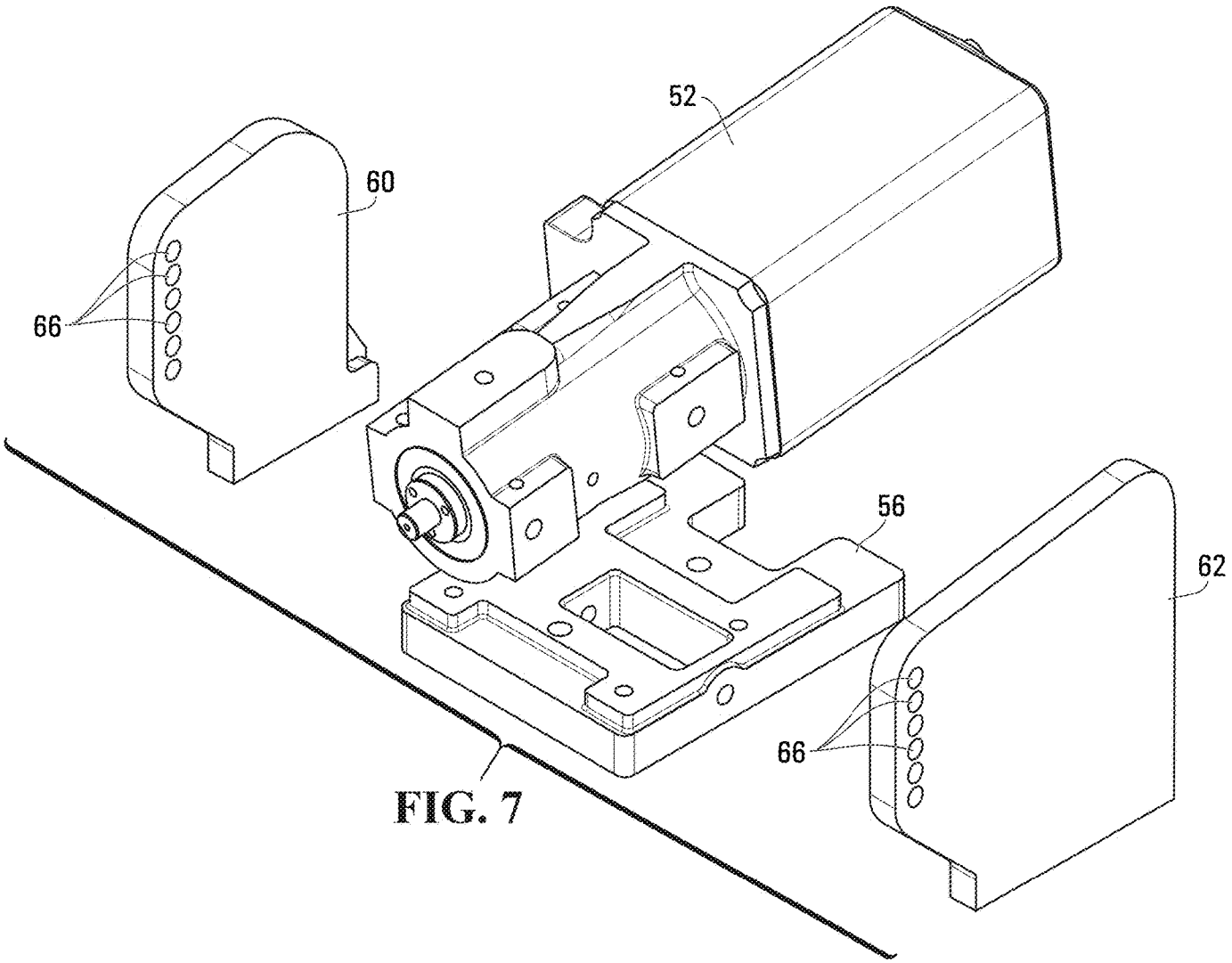
FIG. 7 is an exploded view of an alternative embodiment of the motor tower assembly of FIG. 6*a;*

The device shown in FIGS. 1 to 3 further includes the motor tower assembly 50, the detailed construction of which will be discussed with reference to FIGS. 6*a* to 6*c*. The motor tower assembly 50 is a stable multi-axis positioning device for a rotating sharpening wheel 54 (see FIGS. 1-3). The motor tower assembly 50 includes a tower base 56, a motor 52 for rotating the sharpening wheel 54 and a frame 60 mounted on the tower base 56 and supporting the motor 52. The tower base 56 is mounted on the second sliding carriage 15 of the main base 10 for reciprocation in the second direction 42 perpendicular to the first direction 40. The tower base 56 is rotatably connected with the second sliding carriage by a catch bolt 57 interlocking with an undercut groove 58 (see FIG. 4) extending centrally in the second sliding carriage 15 and in the first direction 40. The tower base 56 can rotate about central a vertical tower axis 59 through 360 degrees on the base 10. The tower base 56 is locked onto second sliding carriage 15 in any desired rotational position by a lock mechanism 80, including a cam shaft 82 extending across tower base 56, which cam shaft engages catch bolt 57 for movement of the bolt to and fro the shaft 82 upon rotation of the shaft 82 by a lever 84. Movement of the bolt 57 towards the shaft 82 pulls the tower base 56 against the second sliding carriage 15, thereby clamping the tower base 56 in place. When the shaft 82 is rotated in the opposite direction the tower base 56 is unclamped and can be rotated on the second sliding carriage 15 about the tower axis 59. The catch bolt is placed towards the center of the tower base 56 to allow placement of the tower base 56 at a position where it is still locked to groove 58 in the second sliding carriage 15, but also overlaps the first sliding carriage 13. This positioning of the tower base 56, which was previously not achievable with conventional grinding centres, is critical to the achievement of all desired orientations of the sharpening wheel relative to the cutting tool 100, when the motor 52 is mounted centrally above the tower base 56 with the motor axis 53 intersecting with the tower axis 59. The frame 60 includes first and second side walls 61, 62 which are mounted spaced apart paralled on the tower base 56 and support the motor 52 therebetween. By supporting the motor 52 centrally between the side walls 61 and 62, the motor axis 53 is oriented to intersect with the tower axis 59. The motor 52 is tiltably mounted by frame bolts 63 rotatably received in apertures 64 in the first and second side walls 61, 62. The frame bolts 63 define the tilt axis about which the motor axis 53 can be tilted in the frame 60 about a tilt axis 67 for tilting of the motor axis 53 from horizontal to an angle to horizontal. The motor tower assembly 50 further includes a tilting assembly 70 (see FIGS. 1-3). The tilting assembly 70 includes a frame 72, a motor carriage 74 slidably received in the frame 72 and a flying lead screw 75 for reciprocation of the motor carriage 74 in the frame 72 by rotation of the screw 75. With this construction, the motor 52 is movable from a first position wherein an end face of the sharpening wheel 54 is parallel to the cutting tool axis and vertical or at different angles from vertical, to a second position wherein the end face is perpendicular to the cutting tool axis 102 and vertical or at different angles from vertical so that the end face of the sharpening wheel 54 faces an axial end face of the cutting tool 100 in the second position, and any position therebetween. By centrally mounting the motor 52 directly above the rotating platform 58 and in such a manner that the motor axis 53 intersects the tower axis 42 at all times, a very balanced, stable and vibration reduced mounting of the sharpening wheel is achieved. Centrally mounting the motor 52 was undesirable in conventional sharpening centres due to the inherent reduction of sharpening wheel orientations in relation to the cutting tool. However, by redesigning the motor tower connection to the associated sliding carriage to provide for positioning of the tower base partially above the sliding carriage for the spindle carriage, the inventor has fully addressed and overcome this disadvantage of the prior art centres, resulting in a more stable and versatile positioning of the sharpening wheel in relation to the cutting tool.

During the grinding process, when the relationship of the tool 100 to the wheel 54 has been established, the motor tower 50 is fixed via locking shaft 82 and catch nut 57, rendering the wheel 54 stable. Then the tool 100 is fed to the wheel 54 for material removal.

The tool spindle assembly 20 combines conventional linear air bearing capability with radius grinding, wheel dressing, and independent feeds in two axes. The multi-axis, variable-speed, reversing motor tower 50 enables a universal approach to the tool being ground. Motor 52 is preferably a variable speed DC motor and the sharpening wheel is preferably a CBN wheel for reducing heat generation during tool grinding, which provides increased control of the integrity of carbide tools during sharpening.

The outer periphery of the milling cutter tool 100 is the part that does the cutting, while the flute face handles the chip evacuation. Accordingly, an end mill grinder must be able to address both the outer periphery and the flute faces in a way that enables accurate profile generation and surface finish without damaging the grinding wheel 54 or overheating the tool material.

In a basic configuration the end mill tool 100 is held in air spindle 25, giving the end mill tool a fixed relationship with the grinding wheel 54 during processing, e.g. a flute outer diameter grinding process. The position of the sharpening wheel 54 is then adjusted by rotation of the motor tower 50 on the second carriage 15 and/or tilting of the motor axis 53 by way of the tilting assembly 70 to orient the sharpening wheel 43 in relation to the end mill tool 100. This allows for dialing in of the proper clearance angles.

Figure 8A:
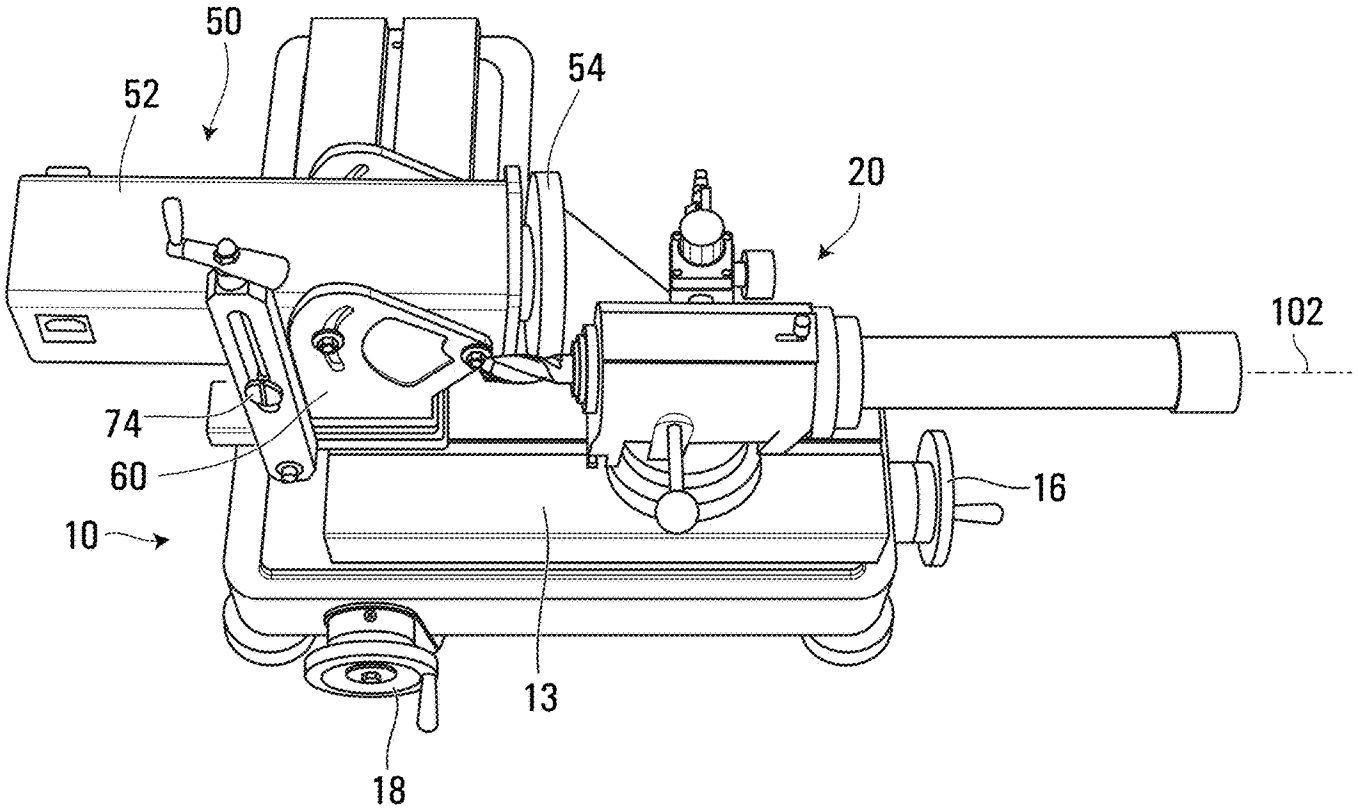
FIG. 8*a* shows the device of FIG. 1 used for outside radial periphery grinding.

FIG. 8*a* illustrates the end-mill grinding device 10 according to the present invention oriented for outside radial periphery grinding. Using the tool spindle carriage 20, the end mill tool 100 is positioned over the tool rest pin 92. The tool rest pin 92 is set to the center height of the spindle center of the end mill tool 100. The motor 52 is then rotated about the tilt axis 67 to the correct angle for the grind depending on the clearance angle required for both the primary and secondary angles of the end mill tool 100. The primary and secondary angles are generally based on the diameter for the end mill tool 100 being sharpened or may vary for special applications. Once set, with the center of the tool rest pin 92 aligned with the edge of the grinding wheel 54, the end mill tool 100 is drawn past the grinding wheel 54 resting on the tool rest pin 92 so as to follow the contour of the end mill tool 100 until a keen edge is restored in sound material.

Figure 8B:
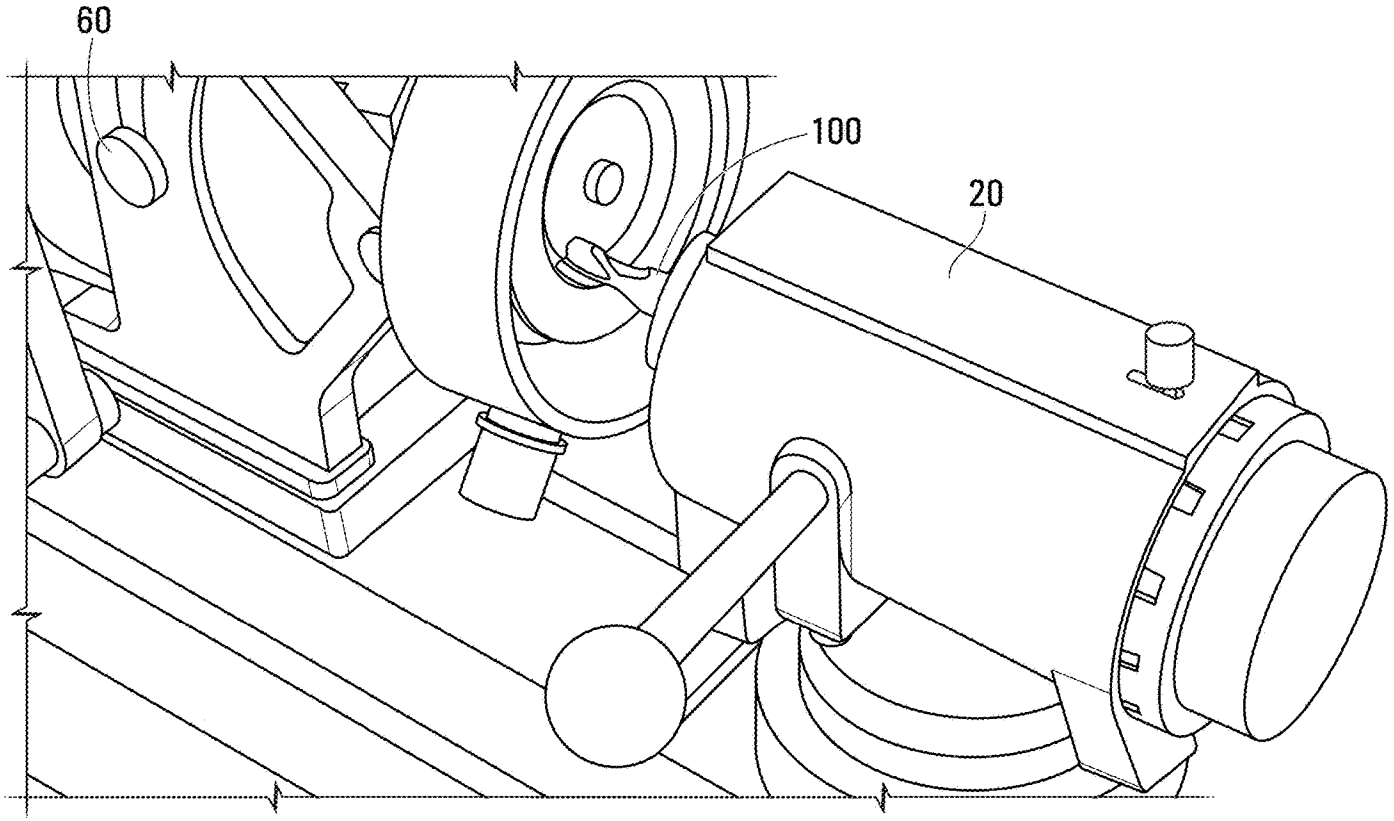
FIG. 8*b* shows the device of FIG. 1 used for corner and end radius grinding.

The arrangement for corner and end radius grinding, common in mold and aerospace work, is illustrated in FIG. 8*b*, wherein there is a need to avoid sharp corner transitions on the end mill tool 100. To produce this feature the end mill tools 100 commonly have rounded corners or ends. The tool 10 of the present invention provides the capability to create or regrind these features accurately, or grind chamfered corners when necessary. Rotation of the motor tower assembly 50 about the vertical tower axis 69, along with reciprocation of the tower base 56 in the second direction 42 enables the end mill tool 100 to be brought into position on the grinding wheel 54. Furthermore, the angle of the grinding wheel 54 can also be adjusted by way of the tilting assembly 70.

Figure 8C:
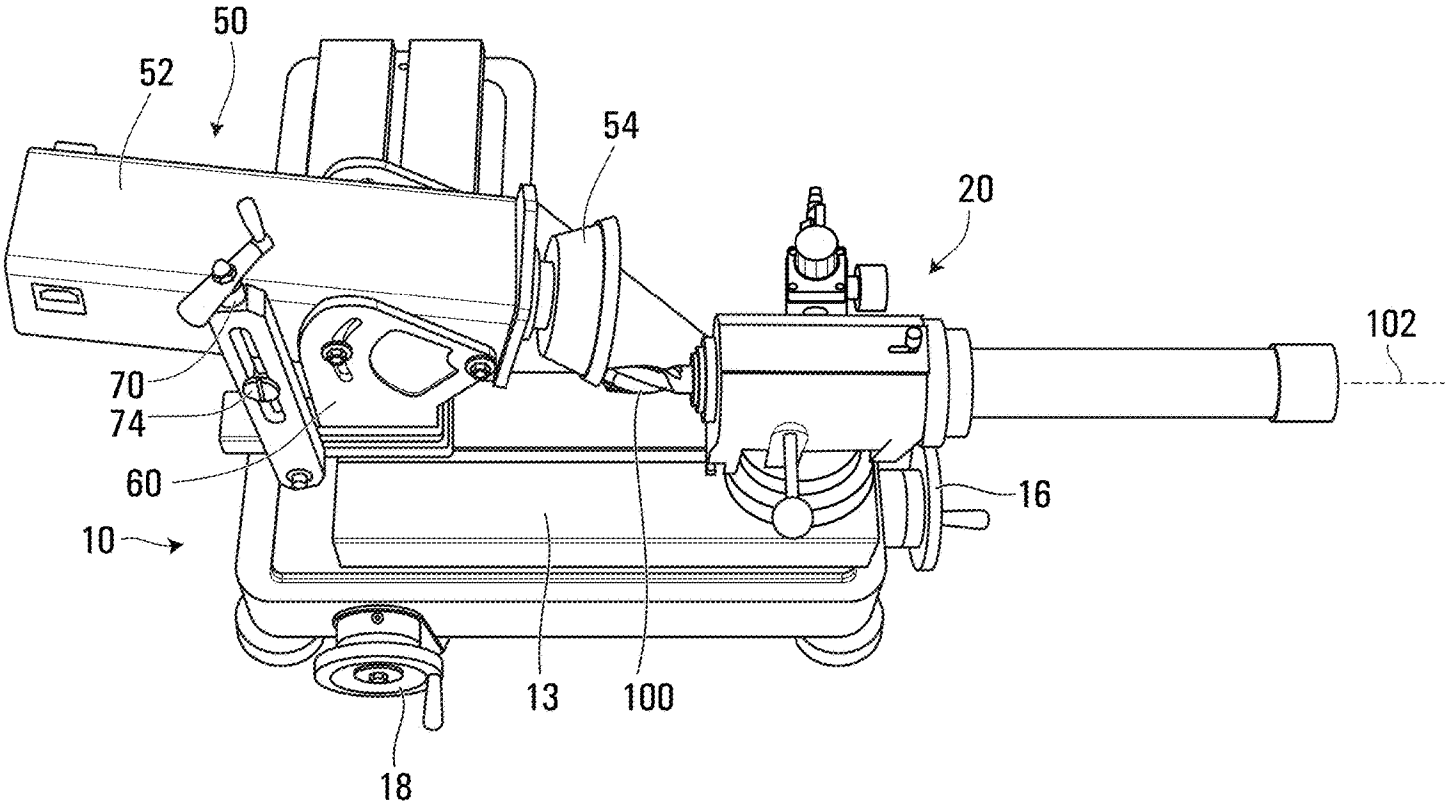
FIG. 8*c* shows the device of FIG. 1 used for end face grinding.

In FIG. 8*c* the end mill grinding device of the present invention uses the end face of the grinding wheel 54 to traverse across the surface of the end mill tool 100 being ground with the tool spindle assembly 20 and the motor axis 53 opposing each other at 180 degrees, i.e. parallel to each other. This is very unlike conventional end mill sharpeners, which grind with the spindle and the motor perpendicular to each other, whereby the outside diameter of an 11V9 style wheel causes the edge of the end mill tool 100 to continuously round off, leaving a peak at the center of the end mill tool which must be manually removed. Accordingly, the motor tower assembly 50 is rotated about its vertical axis 59 until perpendicular to the second direction 42 and then slid along the locking groove 58 into position and locked by shaft 82. T motor axis 53 is tilted by rotation of screw 75 about horizontal tilt axis 67 until horizontal and substantially parallel with the tool spindle carriage 24. The tool spindle assembly 20 is moved into position by sliding the first sliding carriage 13 along the first track 12, rotating the pivot base 22 around a vertical axis until the tool spindle 25 is parallel with the first track 12, and sliding the first carriage 13 and the tool spindle 25 into position, respectively.

A flaw in the design of conventional end mill grinding devices requires that the grinding wheels must be constantly re-profiled and re-dressed to a sharp edge in order to get a good center cutting grind. Composite diamond and CBN wheels cannot be readily re-shaped without elaborate wheel grinding equipment, which is rarely available in a machine shop. The prevention of damage to the grinding wheels and preservation of their shape is necessary to the tool re-sharpening process.

Figure 9:
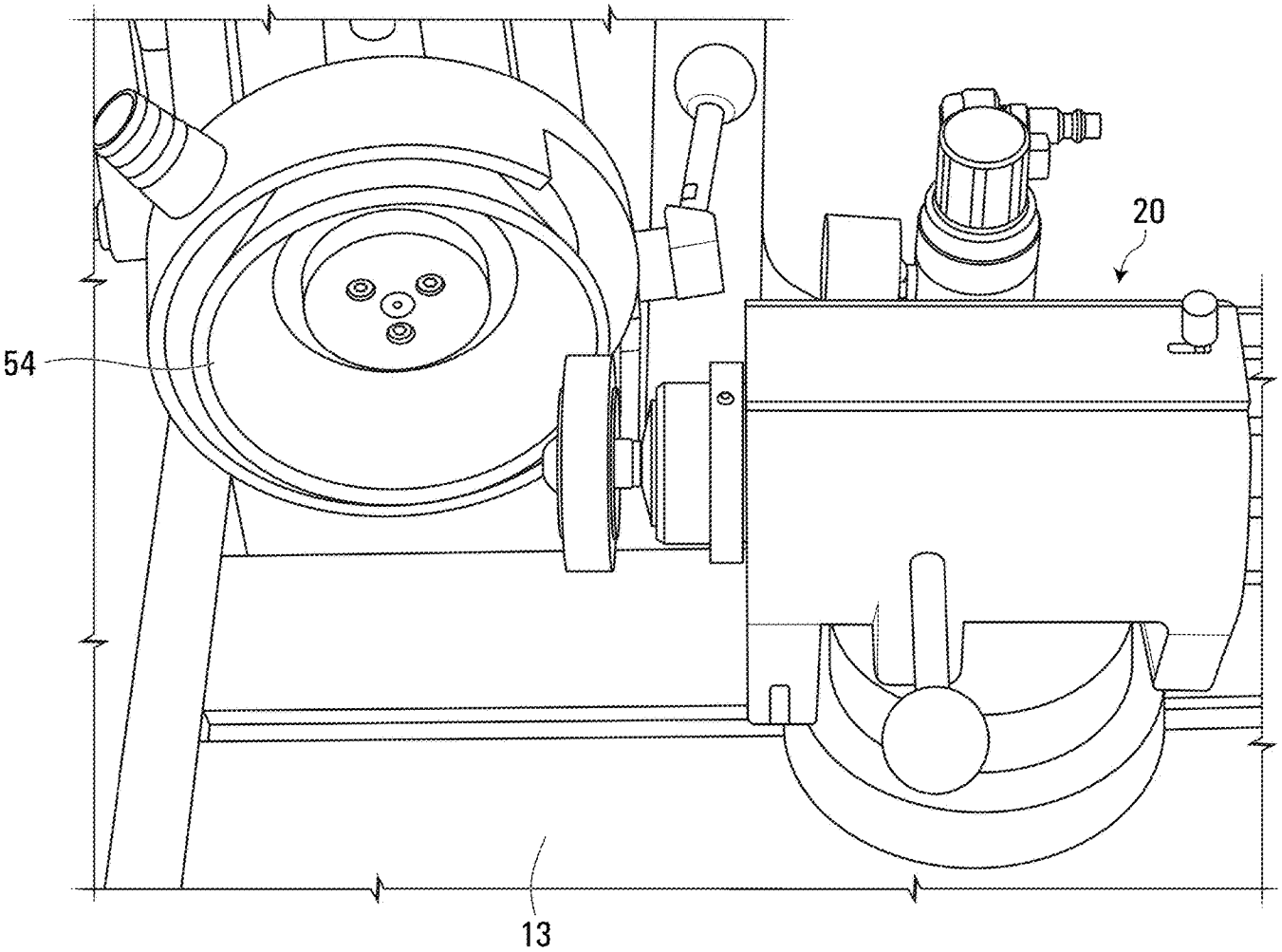
FIG. 9 illustrates how the device of FIG. 1 can be used for truing, contouring and dressing a sharpening wheel.

FIG. 9 illustrates how to true, contour or dress an 11V9 grinding wheel prior to and during the grinding operation. The edge of the grinding wheel must be kept sharp in order to get good features when doing end grinding work.

An advantage of the present invention is the ability to true, contour and dress grinding wheels without the use of separate contrivances common on conventional machines to service grinding wheels, which normally requires the breaking of a set up. Proper grinding wheels, correctly maintained are necessary in order to achieve good results in any grinding process.

What is claimed is:

1. A device for grinding a tool, comprising:

a main base having first and second tracks oriented at a right angle to one another in first and second directions;

a tool spindle assembly for holding the tool for grinding, the tool spindle assembly including a spindle base reciprocatable on the main base along the first track in the first direction; and a tool spindle mounted on the spindle base for receiving and reciprocating the tool along a longitudinal axis of the tool and parallel to the first direction;

a grinding wheel for grinding the tool; and a motor tower assembly for supporting the grinding wheel at different orientations relative to the tool, the motor tower assembly including a tower base reciprocatable on the main base along the second track in the second direction perpendicular to the first direction, the tower base being rotatable on the main base about a vertical tower axis; a motor for rotating the grinding wheel about a motor axis, a motor tower platform rotatable on the tower base about a vertical tower axis; a frame mounted on the platform for supporting the motor with the motor axis intersecting the tower axis, the motor being tiltably mounted in the frame for tilting of the motor axis from horizontal to an angle to horizontal about a tilt axis intersecting with and perpendicular to the motor axis;

whereby the motor is movable from a first position wherein an end face of the grinding wheel is parallel to the tool axis and vertical or at different angles from vertical, to a second position wherein the end face is perpendicular to the tool axis and vertical or at different angles from vertical so that the end face of the grinding wheel faces an axial end face of the tool in the second position, or is positioned beside the cutting tool behind the axial end face, the tower base in the second position partially overlapping the first track.

2. A device for sharpening a rotating cutting tool having a longitudinal tool axis, comprising:

a generally horizontal, planar base;

a tool spindle assembly for holding the cutting tool; and a motor mount assembly for rotating and positioning a tool sharpening wheel at different orientations relative to the cutting tool;

the base including first and second tracks oriented at a right angle to one another, a first sliding carriage mounted on the base for reciprocal movement along the first track in a first direction and a second sliding carriage mounted on the base for reciprocal movement along the second track in a second direction perpendicular to the first direction;

the tool spindle assembly including a rotating platform mounted on the first sliding carriage and rotatable on the first sliding carriage about a vertical axis on the spindle carriage; and a tool spindle mounted on the rotating platform for receiving and reciprocating the cutting tool along a longitudinal axis of the cutting tool; and the motor tower assembly including a tower base mounted to the second sliding carriage and rotatable about a vertical tower axis; a motor for rotating the sharpening wheel about a motor axis, and a frame extending perpendicular to the platform for supporting the motor with the motor axis intersecting the tower axis, the frame tiltably suspending the motor for orientation of the motor axis parallel to the platform or at an angle thereto;

whereby the motor tower is movable from a first position wherein an end face of the sharpening wheel is parallel to the cutting tool axis and vertical or at different angles from vertical, to a second position wherein the end face is perpendicular to the cutting tool axis and vertical or at different angles from vertical so that the end face of the sharpening wheel faces an axial end face of the cutting tool in the second position, or is positioned beside the cutting tool behind the axial end face, the tower base in the second position partially overlapping the first sliding carriage.

3. The tool sharpening device of claim 2, wherein, the second sliding carriage includes a longitudinal dovetail groove extending in the first direction and the tower assembly includes a lock for interlocking engagement with the dovetail groove and for locking the tower base to the second sliding carriage at selected rotational positions.

4. The device of claim 3, wherein the main base further includes a first spindle engaging the first sliding carriage for reciprocating the first sliding carriage on the base along the first track upon rotation of the first spindle.

5. The device of claim 4, wherein the main base further includes a second spindle engaging the second sliding carriage for reciprocating the second sliding carriage on the main base along the second track upon rotation of the second spindle.

6. The device of claim 2, wherein the motor tower assembly further includes a tilt carriage mounted on the tower base and attached to the motor for tilting of the motor axis about the tilt axis.

7. The device of claim 6, wherein the tilt carriage includes a flying lead screw spindle assembly for controlling reciprocating motion of the tilt carriage.

8. The device according to claim 7, further comprising first and second grooves in the main base extending perpendicular to each other for receiving and guiding the first sliding carriage and the second sliding carriage, respectively, during reciprocation.

* * * * *